US005082262A

United States Patent [19]

Sanchez

[11] Patent Number: 5,082,262

[45] Date of Patent: Jan. 21, 1992

[54] TRAINING DEVICE FOR BASEBALL BATTER AND METHOD THEREFOR

[76] Inventor: Richard D. Sanchez, 18910 SW. 93rd Ave., Miami, Fla. 33157

[21] Appl. No.: 729,616

[22] Filed: Jul. 15, 1991

[51] Int. Cl.[5] ..... A63B 69/00

[52] U.S. Cl. ..... 273/26 R

[58] Field of Search ..... 273/26 R, 26 C

[56] References Cited

U.S. PATENT DOCUMENTS

| | | | |
|---|---|---|---|
| 2,134,451 | 10/1938 | Mogren | 273/26 R X |
| 3,169,022 | 2/1965 | Kretsinger | 273/26 R X |
| 3,368,541 | 2/1968 | Brink | 273/26 R X |
| 4,194,735 | 3/1980 | Wilson | 273/26 R |
| 4,225,133 | 9/1980 | Kiray | 273/26 R |
| 4,577,868 | 3/1986 | Kiyonaga | 273/26 R X |
| 4,955,608 | 9/1990 | Dougherty et al. | 273/26 C X |

*Primary Examiner*—William H. Grieb
*Attorney, Agent, or Firm*—RObert C. Kain, Jr.

[57] ABSTRACT

The training device for improving a baseball batter's swing includes a forward foot actuated switch which is normally open but is closed when the baseball batter takes the short forward foot step during the batter's swing. A wrist movement switch in one embodiment is mechanically linked to a wrist strap on the aft or rearward wrist of the batter. The wrist switch is normally closed and is subsequently opened due to the swinging motion of the wrist during the batter's swing movement. An alarm system is coupled to the foot switch and the wrist switch and further includes, in one embodiment, an audible alarm device which is activated thereby issuing an alarm upon a predetermined sequential movement of the batter's forward foot and wrist during the swing movement. The predetermined sequential movement is the batter's short step, that closes the foot switch, prior to the batter's swinging of the wrist. Movement of the wrist during the bat swing opens the wrist switch and deactivates the alarm. The alarm sounds when the foot switch is closed and the wrist switch remains closed due to the batter taking the short foot step prior initiating the bat swing as sensed by wrist movement.

8 Claims, 2 Drawing Sheets

TRAINING DEVICE FOR BASEBALL BATTER AND METHOD THEREFOR

BACKGROUND OF THE INVENTION

The present invention relates to a training device utilized to teach a baseball batter to improve his or her swing.

U.S. Pat. No. 4,225,133 to Kiray discloses a device for teaching batting techniques which includes a base platform having a well for the batter's aft or rear foot, an arm that provides a yieldable barrier for the batter's forward foot, and a cord or cable that checks the batter's swing at levels above his strike zone. U.S. Pat. No. 4,577,868 to Kiyonaga discloses a golf swing training device which includes a plurality of aligned pressure sensors for detecting the golfer's shifting weight during the golf swing and memory circuits that are utilized to issue alarms advising the golfer of the proper weight shifts during the golf swing. U.S. Pat. No. 4,955,608 to Dougherty discloses an athletic movement trainer used by tennis players. The trainer has straps that attach to the ankles of the tennis player and a cord extending from those ankle straps to a loop on a belt around the waist of the tennis player.

OBJECTS OF THE INVENTION

It is an object of the present invention to provide a training device to improve the swing of a baseball batter.

It is another object of the present invention to provide a training device which senses the predetermined sequential movement of the batter's forward foot with respect to the batter's wrist during the entire baseball bat swing.

It is a further object of the present invention to provide a training device which issues an audible alarm when the batter first takes a short foot step with his forward foot prior to moving his wrist.

It is an additional object of the present invention to issue the audible alarm and positively reinforce the proper sequential movement of short step and then bat swing to train the batter.

SUMMARY OF THE INVENTION

The training device for improving a baseball batter's swing includes a forward foot actuated switch which is normally open but is closed when the baseball batter takes the short forward foot step during the batter's swing. A wrist movement switch in one embodiment is mechanically linked to a wrist strap on the aft or rearward wrist of the batter. The wrist switch is normally closed and is subsequently opened due to the swinging motion of the wrist during the batter's swing movement. An alarm system is coupled to the foot switch and the wrist switch and further includes, in one embodiment, an audible alarm device which is activated thereby issuing an alarm upon a predetermined sequential movement of the batter's forward foot and wrist during the swing movement. The predetermined sequential movement is the batter's short step, that closes the foot switch, prior to the batter's swinging of the wrist. Movement of the wrist during the bat swing opens the wrist switch and deactivates the alarm. The alarm sounds when the foot switch is closed and the wrist switch remains closed due to the batter taking the short foot step prior initiating the bat swing as sensed by wrist movement.

BRIEF DESCRIPTION OF THE DRAWINGS

Further objects and advantages of the present invention can be found in the detailed description of the preferred embodiment when taken in conjunction with the accompanying drawings in which.

FIG. I diagrammatically illustrates a batter using the training device.

DETAILED DESCRIPTION OF THE PREFERRED EMBODIMENT

The present invention relates to a training device that improves the swing of a baseball batter.

Figure 1:
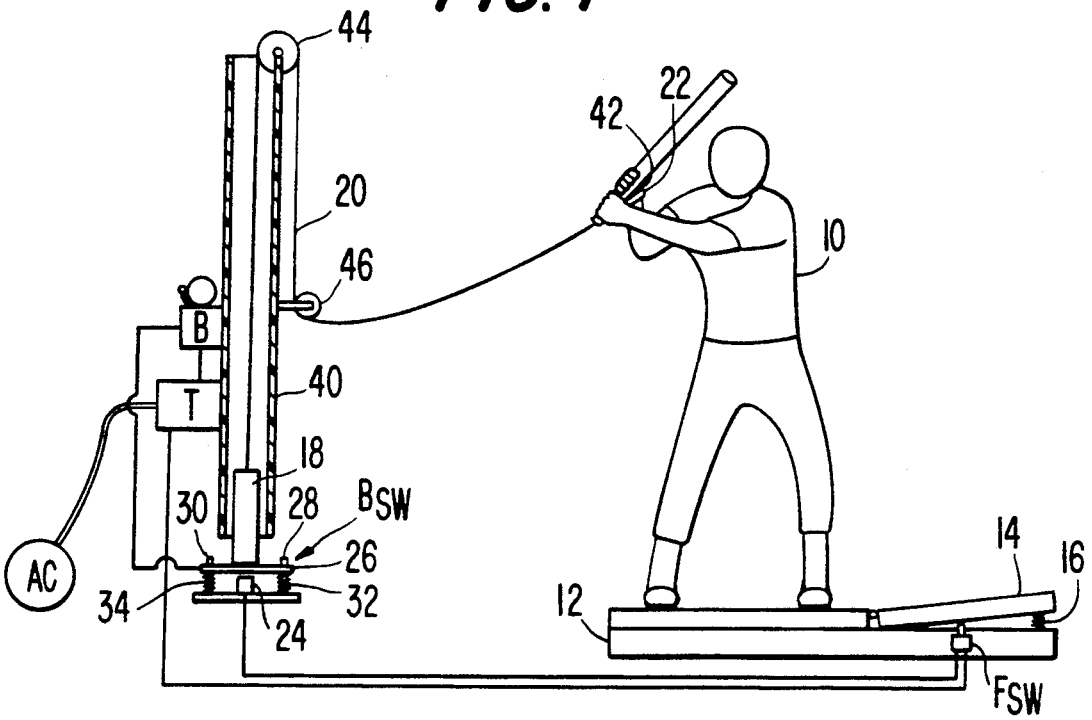

FIG. 1 diagrammatically illustrates the training device and batter 10. Batter 10 stands on platform 12 that has, in the illustrated embodiment, a hinged forward plate 14. Forward plate 14 is biased upward by spring 16 such that when batter 10 takes the short foot step of the batter's swing movement (see FIG. 5), the forward foot plate 14 is depressed thereby actuating foot switch $F_{SW}$. In the preferred embodiment, switch $F_{SW}$ is in a normally open state and depression of moveable plate 14 closes that switch. Forward foot plate 14 can be a pressure sensitive plate (i.e., not hinged) sensitive to any foot step by batter 10 rather than a hinged plate mechanically actuating electrical switch $F_{SW}$. In addition, the control signal generated by switch $F_{SW}$ can be pneumatic dependent upon the configuration of the pressure sensitive plate.

The forward foot actuated switch means, in the illustrated embodiment, includes movable forward foot plate 14 and switch $F_{SW}$ or, in alternate embodiments, includes a pressure sensitive plate or pneumatic, hydraulic or optic sensors. The foot switch means is coupled to a wrist movement actuated switch means which consists, in general, of electrical switch configuration $B_{SW}$. The batter switch $B_{SW}$ or wrist activated switch includes, in the illustrated embodiment, a mechanical linkage including weight 18, cable 20, and wrist strap or attachment 22. In particular, one side of foot switch $F_{SW}$ is electrically connected to lower contact 24 of batter switch $B_{SW}$. Upper contact 26 of the batter switch is vertically movable on pins 28 and 30 (see FIG. 2) and is biased upward by a pair of springs 32 and 34 when weight 18 is lifted off upper contact plate 26. Weight 18 travels in tubular tower 40 under the control of cable 20 and ultimately the movement of aft wrist 42 of batter 10. Cable 20 is mechanically linked to wrist strap 22 by a pulley system which, in one embodiment, includes pulleys 44 and 46.

Batter or wrist switch $B_{SW}$ and, in particular, upper contact plate 26 is electrically coupled to a bell B which in turn is electrically coupled to a transformer T. The transformer receives alternating current (AC) from an AC power source and, in the illustrated embodiment, converts that AC power into approximately 12 volts DC (direct current). One side of the transformer is connected to bell B while the other side of the transformer is connected to the other pole of foot switch $F_{SW}$.

Figure 2:
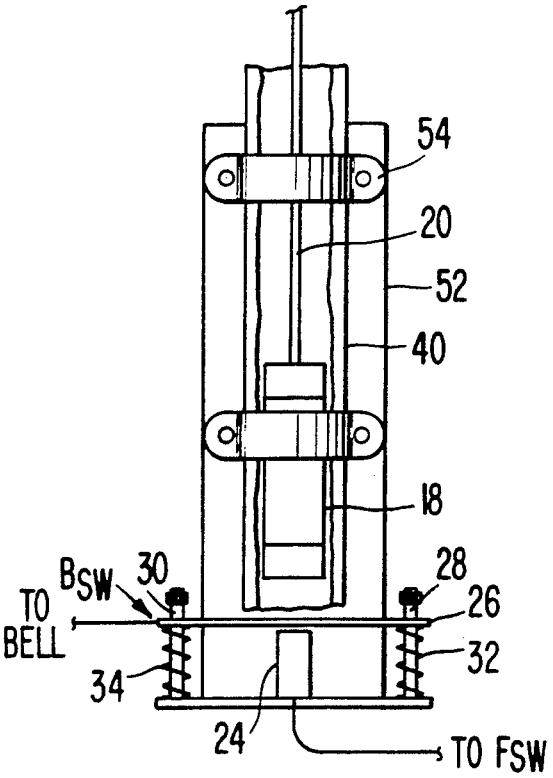
FIG. 2 is a detail, partially broken away view of the batter switch which senses wrist movement.

FIG. 2 diagrammatically illustrates a partial, broken away view of the control tower and, in particular, tubular pipe 40 attached to support 52 via straps, one of which is strap 54. In a current working embodiment, weight 18 is a copper pipe having copper caps at both ends and support 52 is made of wood. FIG. 2 illustrates the position of weight 18 after it has been lifted from movable upper contact plate 26 by the wrist of the batter after the batter initiates the bat swing during the batter's swing movement. Movable contact plate 26 has moved upward due to th biasing action of springs 32 and 34 thereby opening the contact between lower contact 24 and upper movable contact plate 26. FIG. 2 illustrates the open state condition of batter or wrist switch $B_{SW}$ when the batter has moved his wrist during the batter's swing movement. In one embodiment, tubular pipe 40 is a 1½" PVC pipe and pins 28 and 30 are approximately 2" high. Accordingly, springs 32 and 34 move upper contact plate 26 about ½" above lower contact 24 in order to open the batter switch $B_{SW}$.

Figure 4:
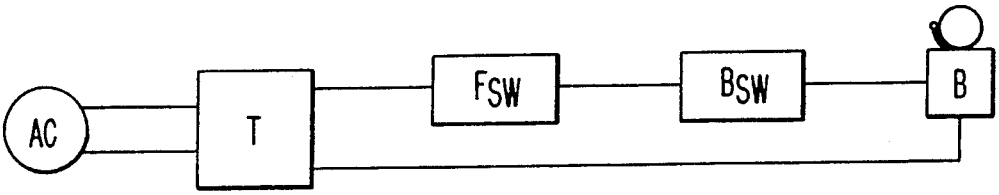
FIG. 4 is a electrical block diagram for the system.

FIG. 4 is an electrical block diagram of the system showing the AC power source connected to transformer T. One terminal of transformer T is connected to foot switch $F_{SW}$ which in turn is connected to batter switch $B_{SW}$. The other pole of batter switch $B_{SW}$ is connected to bell B which, in turn, is connected to the opposite terminal of transformer T.

Figure 3:
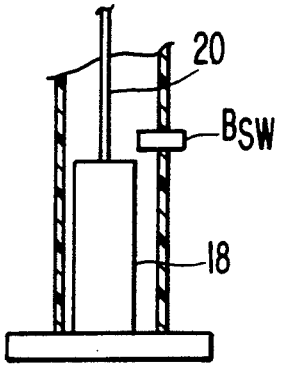
FIG. 3 is a partial cross-sectional view of another embodiment for the batter or wrist switch.

FIG. 3 diagrammatically illustrates an alternate embodiment of batter switch $B_{SW}$ wherein the position of weight 18 actuates the batter switch $B_{SW}$. In this illustrated embodiment, batter switch $B_{SW}$ includes a roller which closes the switch when weight 18 exceeds a predetermined height. Any type of movement or position sensitive switch could be used as batter or wrist switch $B_{SW}$ in order to determine when the batter has begun moving his wrist during the batter's swing movement.

Figure 5:
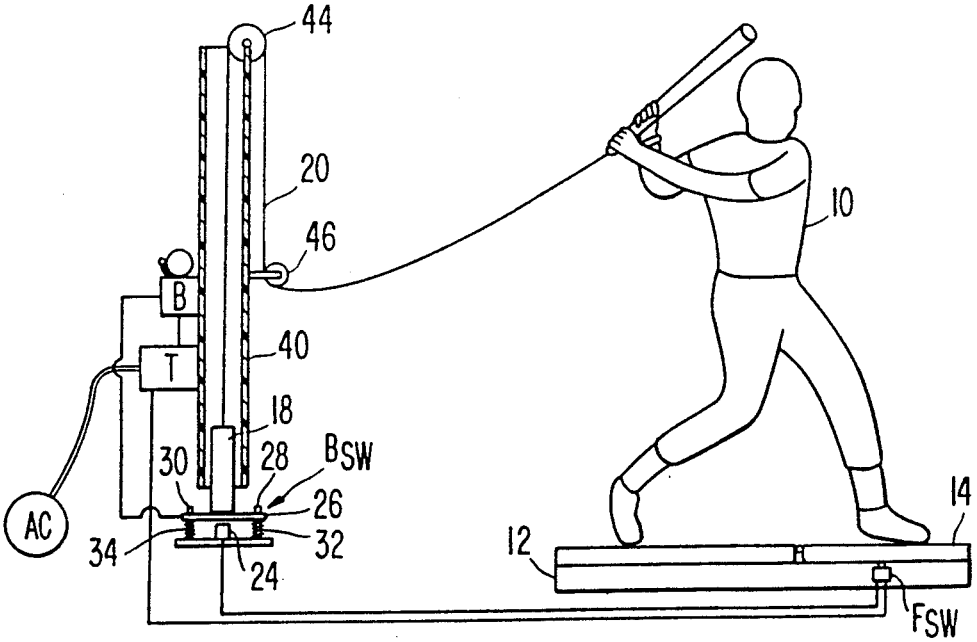
FIG. 5 diagrammatically illustrates the batter executing the predetermined sequential movement of short step prior to wrist movement and hence bat swing.

FIG. 5 diagrammatically illustrates batter 10 depressing forward plate 14 during the short foot step of the batter's swing movement. As illustrated in FIG. 5, batter 10 has not yet begun the wrist movement portion of his swing movement. Accordingly, in this embodiment foot switch $F_{SW}$ is in a closed state and batter switch $B_{SW}$ is also in a closed state. The closure of both switches causes an audible alarm to be generated by bell B. Batter switch $B_{SW}$ is in a normally closed state.

In order to train a batter such that the batter does not swing his or her bat until after the batter takes the short foot step with his or her forward foot, the present training system issues an alarm when a predetermined sequential movement of the batter's forward foot viz a vis the batter's wrist occurs. The predetermined sequential movement is preferably the short foot step prior to the initiation of the batter's swing as sensed by movement of the batter's wrist. If the batter executes the predetermined sequential movement of short step prior to initiation of the bat swing, the audible alarm sounds If the batter swings concurrently with the short foot step or begins his or her swing before the short foot step, no alarm is generated. The State Table that follows illustrates this condition.

STATE TABLE

| Foot | Wrist | $F_{SW}$ | $B_{SW}$ | Bell |
|---|---|---|---|---|
| No Step | No Swing | O | C | Off |
| No Step | Swing | O | O | Off |
| Step | Swing | C | O | Off |
| Step | No Swing | C | C | On |

Bell
On - Ring
Off - No Ring
Switch
O - Open
C - Closed
$F_{SW}$ = Foot Actuated Switch
$B_{SW}$ = Batter Wrist Actuated Switch Of course, the bell could be replaced with other alarm systems such as lights, flags, etc. In addition, the predetermined sequential movement sensed by the training device can be altered by changing the normal states of foot switch $F_{SW}$ and batter switch $B_{SW}$. As stated earlier, foot switch $F_{SW}$ is normally open and batter switch $B_{SW}$ is normally closed. Although the system is powered by alternating current in the illustrated embodiment, a battery could used and the AC power source and transformer could be eliminated. Rather than switches being mechanically actuated, photoelectric or optical devices could be used to sense the short foot step and wrist movement of the batter.

The claims appended hereto are meant to cover modifications and changes within the spirit and scope of the present invention.

What is claimed is:

1. A training device for a batter swinging a baseball bat comprising:

a forward foot actuated switch means adapted to be actuated by a forward placed foot of said batter during a short foot step of a batter's swing movement;

a wrist movement actuated switch means coupled to a wrist of said batter and adapted to be actuated by a swing motion of said wrist during said batter's swing movement; and, an alarm system coupled to said foot switch means and said wrist switch means, said alarm system having means for issuing an alarm based upon a predetermined sequential movement of said batter's forward foot and said batter's wrist during said batter's swing movement.

2. A training device as claimed in claim 1 wherein the means for issuing said alarm includes an audible alarm device.

3. A training device as claimed in claim 2 wherein said foot switch means is in a normally open state, said wrist switch means is in a normally closed state, and said means for issuing an alarm actuates said audible alarm device when said batter's forward foot actuates said foot switch means during said short foot step prior to actuation of said wrist switch means during said swing motion of said wrist as said predetermined sequential movement.

4. A training device as claimed in claim 1 wherein said foot switch means, said wrist switch means and said means for issuing an alarm are electrically coupled together.

5. A training device as claimed in claim 4 wherein said wrist switch means includes a wrist attachment for said batter's wrist and a mechanically actuated switch linked to said wrist attachment.

6. A training device as claimed in claim 2 wherein said foot switch means includes a pressure sensitive plate adapted to be depressed during said short step of said batter's swing movement.

7. A training device as claimed in claim 5 wherein said wrist switch means further includes a cable and pulley linkage between said wrist attachment and said mechanically actuated switch.

8. A method for training a batter swinging a baseball bat comprising the steps of:

sensing a physical attribute of a short foot step of a forward placed foot of a batter during a batter's swing movement;

sensing a physical attribute of a wrist movement of a rearward wrist of a batter during the batter's swing movement;

issuing an alarm directed at said batter based upon the physical attributes of said forward foot and said wrist when the foot sensing step senses the short foot step prior to sensing the wrist movement during the batter's swing movement; and, not issuing an alarm in the absence of sequentially sensing the foot step prior to the wrist movement.

* * * * *